US009392852B1

(12) United States Patent
Houston

(10) Patent No.: US 9,392,852 B1
(45) Date of Patent: Jul. 19, 2016

(54) PARASOL MADE OF REMOVABLE FEATHER FANS

(71) Applicant: Jessica O. Houston, Anchorage, AK (US)

(72) Inventor: Jessica O. Houston, Anchorage, AK (US)

( * ) Notice: Subject to any disclaimer, the term of this patent is extended or adjusted under 35 U.S.C. 154(b) by 0 days.

(21) Appl. No.: 14/678,368

(22) Filed: Apr. 3, 2015

(51) Int. Cl.
*A45B 15/00* (2006.01)
*A45B 25/18* (2006.01)

(52) U.S. Cl.
CPC ..... *A45B 15/00* (2013.01); *A45B 25/18* (2013.01)

(58) Field of Classification Search
CPC ... A45B 15/00; A45B 25/18; A45B 2025/186
USPC ..... 135/19, 19.5, 33.2, 33.4, 33.41
See application file for complete search history.

(56) References Cited

U.S. PATENT DOCUMENTS 238,365 A * 3/1881 Dennis ..... A45B 3/00 135/19.5
3,478,759 A * 11/1969 Ehrman ..... A45B 23/00 135/15.1
4,370,993 A * 2/1983 Desaleux ..... A45B 25/02 135/19.5
4,836,231 A * 6/1989 Peterson ..... A45B 17/00 135/117
4,836,232 A * 6/1989 De Rosa ..... A45B 11/00 135/118
5,947,139 A * 9/1999 Lebrecht ..... A45B 23/00 135/132
6,192,967 B1 * 2/2001 Huang ..... B60J 1/2091 160/134

* cited by examiner

*Primary Examiner* — Noah Chandler Hawk
(74) *Attorney, Agent, or Firm* — Michael J. Tavella

(57) ABSTRACT

A convertible parasol and fan pair using a specially constructed post/handle that has a top to receive the fans. The top has a graduated upper surface with hook and loop fastener components that match a corresponding hook and loop fasteners attached to the arms of the fans. In this way, a dancer can quickly attach a pair of fans to the top of the post to form a parasol, which can then be used in the performance. At the desired time, the fans can quickly be removed to continue the performance in another direction. The ability to quickly change from fans to a parasol and then back to fans is a desired performance-enhancing tool.

5 Claims, 8 Drawing Sheets

PARASOL MADE OF REMOVABLE FEATHER FANS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to feather fans and particularly to feather fans that can covert to a parasol.

2. Description of the Prior Art

For many years dancers have performed on stage using a variety of props. Many times, feather fans (typically made of ostrich feathers) have been used. Also a variety of parasols have been used as well. These props enhance the stage performance and have proved popular throughout the years.

BRIEF DESCRIPTION OF THE INVENTION

The instant invention takes the fan and parasol in a different direction. The invention consists of a specially constructed post/handle that has a top to receive the fans. The top has a graduated upper surface with hook and loop fastener components that match a corresponding hook and loop fasteners attached to the arms of the fans. In this way, a dancer can quickly attach a pair of fans to the top of the post to form a parasol, which can then be used in the performance. At the desired time, the fans can quickly be removed to continue the performance in another direction. The ability to quickly change from fans to a parasol and then back to fans is a desired performance-enhancing tool.

DESCRIPTION OF THE INVENTION

Figure 1:
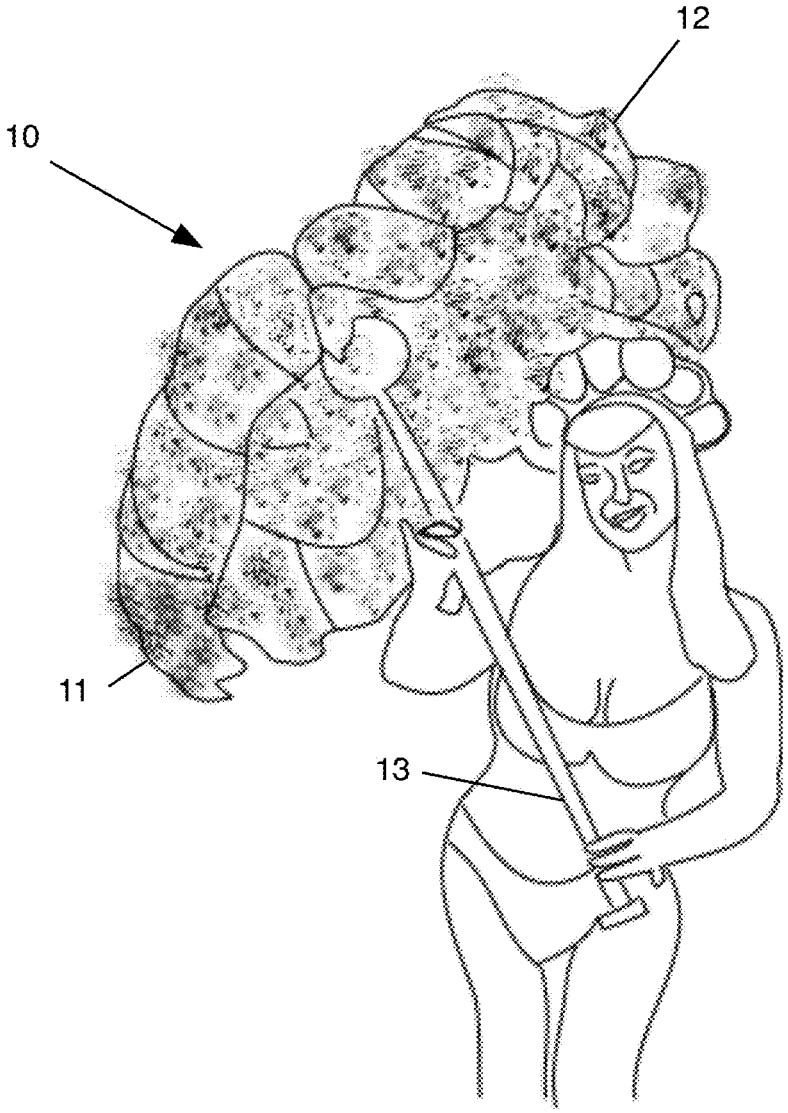
FIG. 1 is a detail view of a dancer using the assembled parasol.
Figure 2:
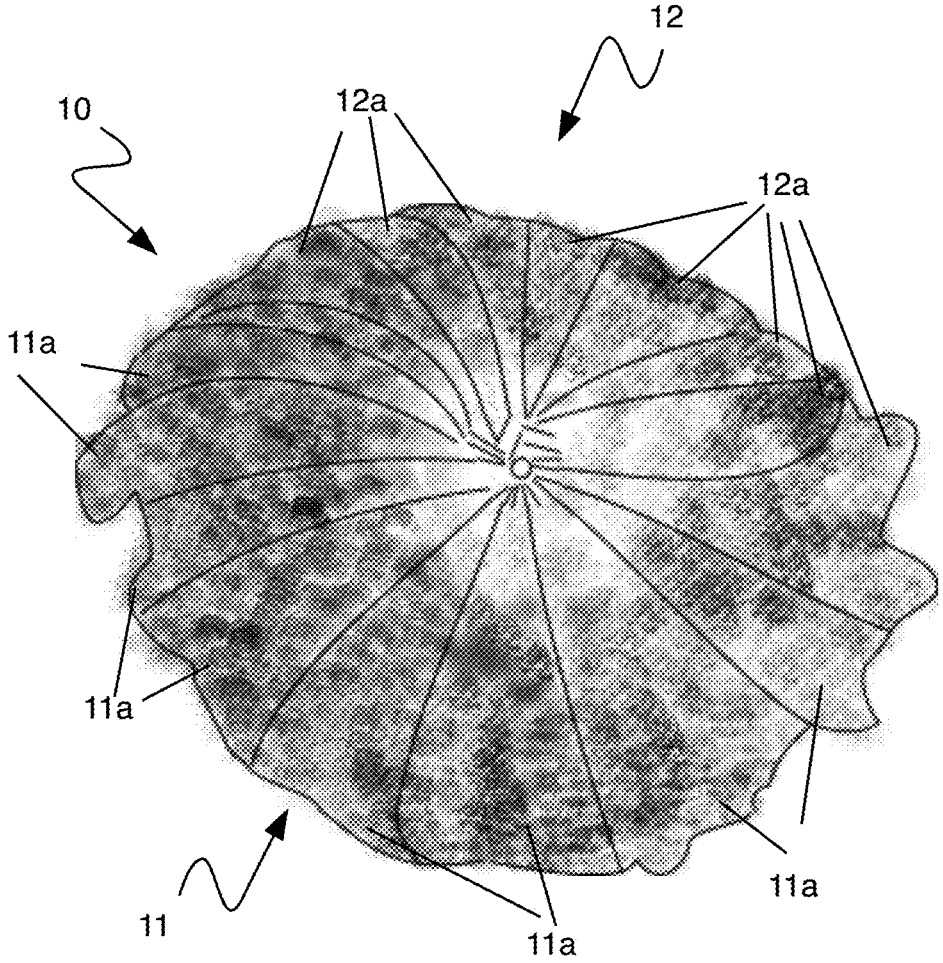
FIG. 2 is a top perspective view of the parasol showing the arms of the fans extending out and forming the parasol shape.

Referring now to FIG. 1, a detail view of a dancer using the assembled parasol 10. As noted above, the parasol is made of two fans 11 and 12 and a support pole 13. FIG. 2 is a top perspective view of the parasol 10 showing the arms 11*a* and 12*a* of the fans that extend out and form the parasol shape.

Figure 3:
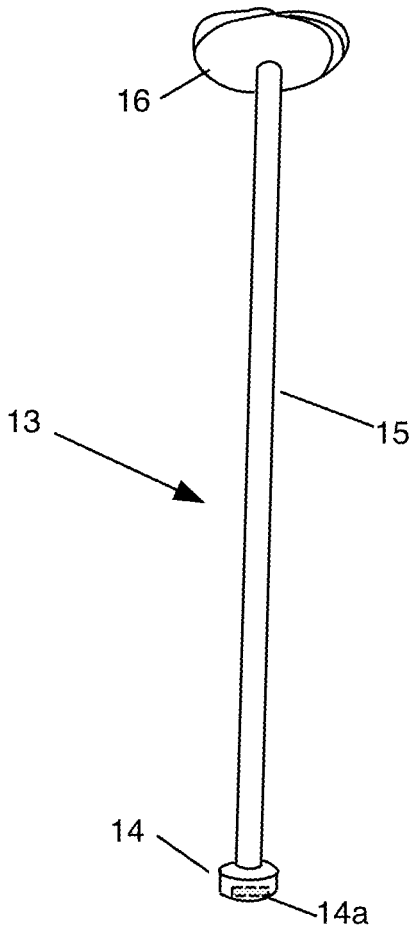
FIG. 3 is a bottom perspective view of the pole/handle of the device.

FIG. 3 is a bottom perspective view of the pole/handle 13 of the device. Here, the pole 13 has a number of parts. The base 14 is cylindrical and is weighted. In this way, the pole 13 can be placed on a stage out of the way where it can remain upright to be used quickly to form the parasol. A magnet 14*a* may also be placed in the base for stages that have ferrous metal parts. The magnet helps the pole remain standing when not in use. A central shaft 15 extends up from the base as shown. The shaft 15 is a cylindrical member sized to be gripped by hands. At the top is a formed top piece 16, which is discussed in greater detail below. Note that the pole 13 can be decorated with paint or glitter to other accessories as desired for better display during a performance.

Figure 4:
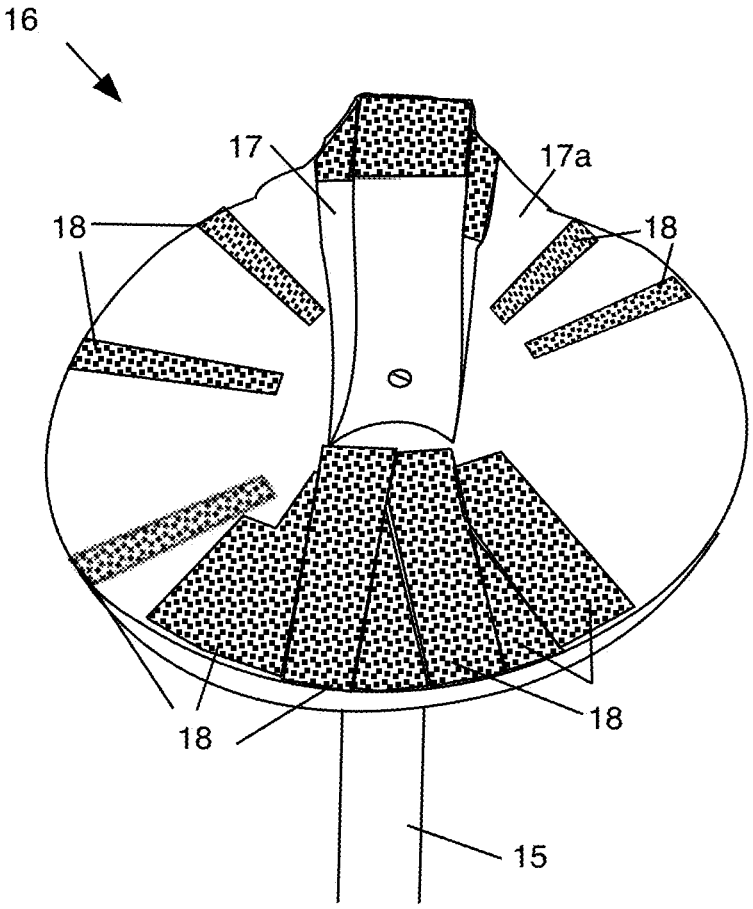
FIG. 4 is a top perspective view of the pole/handle of the device.
Figure 5:
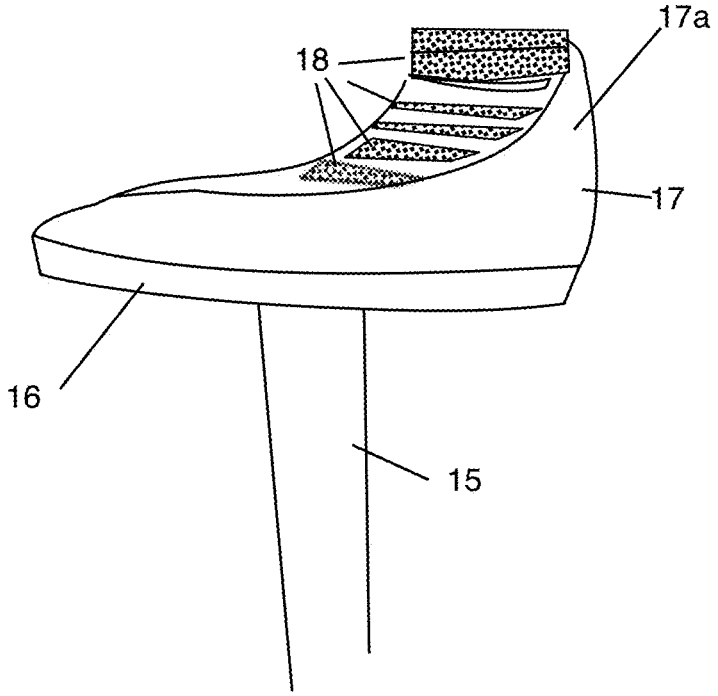
FIG. 5 is a side perspective view of the top portion of the pole/handle of the device.

FIG. 4 is a top detail view and FIG. 5 is a side detail view of the formed top piece 16. Note that it is generally circular and has a ramped portion 17 located in one portion of the top plate. Note that this ramped portion flows around the top plate. As shown, the ramp portion 17 is made up of a number of steps 17*a*. See FIG. 5. Note, too sections of hook type fastener 18 (as part of a hook and loop type fastener) are installed about the top plate 16 as shown. Note too in FIG. 5, the ramp 17. The ramp is designed to accommodate the slats that make up the fan, as discussed below. The ramp allows the open fan to fit against the top plate so that it forms a smooth crown for the parasol.

Figure 6:
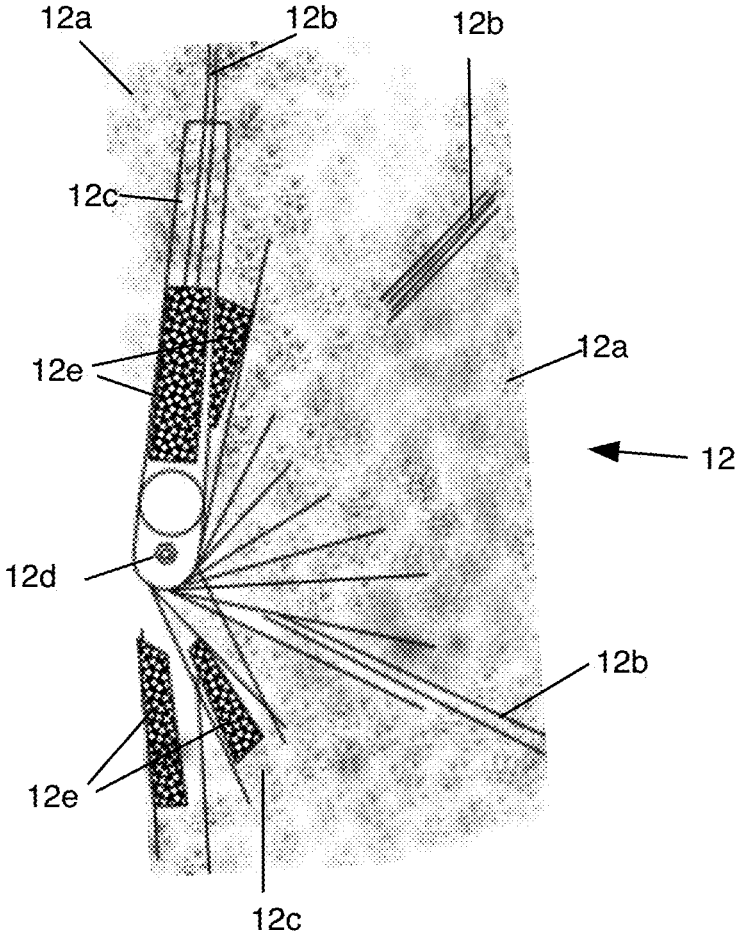
FIG. 6 is a detail view of a portion of a fan showing the arms opened and the hook portion of a hook and loop type fastener attached.

FIG. 6 is a detail view of a portion of a fan showing the arms opened and the hook portion of a hook and loop type fastener attached. Here, a portion of a fan 12 is shown. Each fan is made up of a number of feathers, typically ostrich feathers 12*a*. Each feather has a shaft 12*b*. The ends of the shafts are connected to a number of paddles 12*c*. These paddles are connected with a fastener 12*d* as shown. When closed, the paddles for a vertical stack. The paddles can then be opened to produce an open fan. Each paddle of the fan is fitted with a loop type fastener 12*e* that corresponds to the hook type fastener on the top plate 16 of the handle 16.

Figure 7:
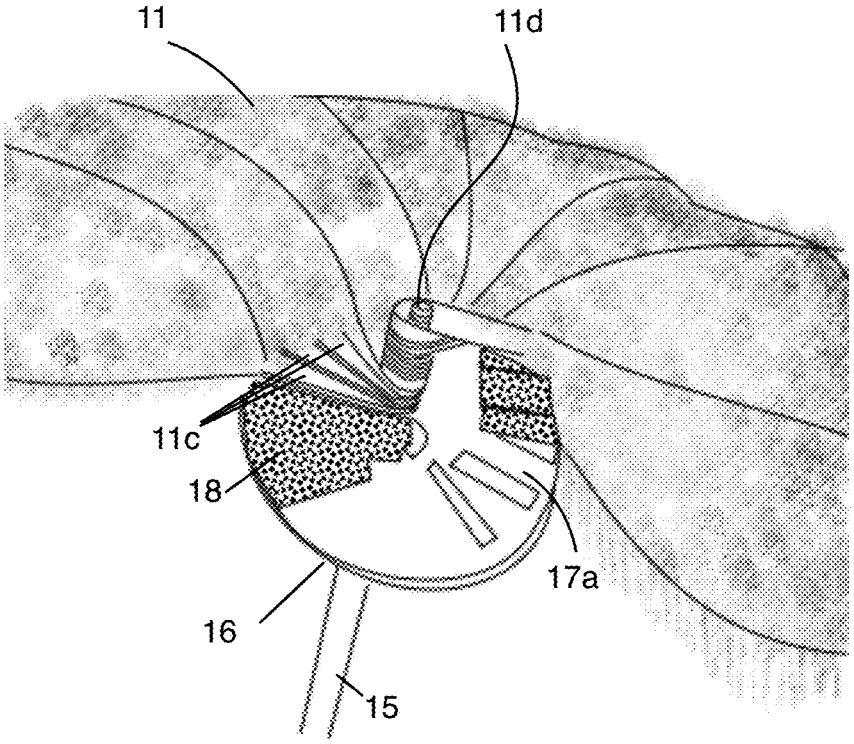
FIG. 7 is a top detail view of the post/handle showing one fan opened and attached to the pole/handle.

FIG. 7 is a top detail view of the post/handle 13 showing one fan 11 opened and attached to the pole/handle 13. In this figure, the fan 11 is shown open. This fan is identical in construction t the fan 12, including the paddles 11*c* and the hub 11*d* as well as the shafts and feathers. Note how the paddles 11*c* spread to cover the top plate of the handle. The hook and loop type fasteners on the top plate and the paddles allow for quick attachment and removal of the fans to and from the handle 13. Note too, how the steps 17*a* of the top plate align with the stacked paddles, as discussed below.

Figure 8:
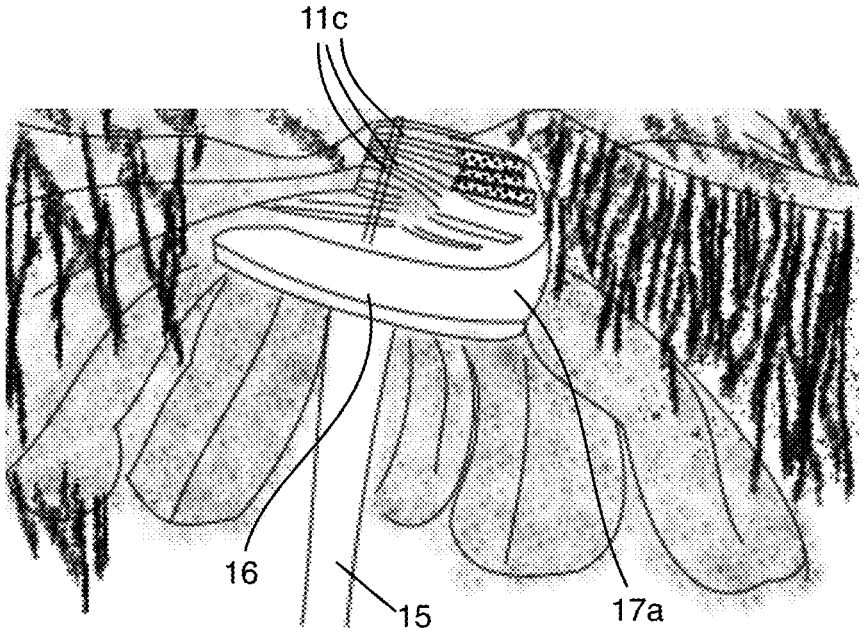
FIG. 8 is a side detail view of the top of the pole/handle showing the arrangement of fan arms on the top portion of the pole/handle.

FIG. 8 is a side detail view of the top plate 16 of the pole/handle 13 showing the arrangement of fan paddles 12*c* on the top portion of the pole/handle. In this figure the paddles can be seen in a stacked arrangement. The other fan is attached in a similar way to the top plate of the handle to form the parasol as shown in FIGS. 1 and 2.

When done, the user can quickly remove the fans from the handle to continue the performance using just the fans. In this way, a dancer can go from fans to parasol and back during the course of a performance without difficulty.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A parasol using removable feather fans comprising:

a) a handle portion having a base, a central shaft, and a formed top, said top having a plurality of hook and look type fastener strips thereon;

b) a first feather fan having a plurality of arms, extending out from a central pivot point, each of said plurality of arms being attached to said central pivot point, and further wherein each of said arms has a strip of hook and loop type fastener; and c) a second feather fan having a plurality of arms, extending out from a central pivot point Each of said plurality of arms being attached to said central pivot point, and further wherein each of said arms has a strip of hook and loop type fastener;

d) whereby when said first and second fans are attached to the top of said handle portion using said strips of hook and loop type fastener, the fans and handle form a parasol.

2. The parasol of claim 1 wherein the base of said handle portion is weighted.

3. The parasol of claim 1 wherein the base of the handle portion is magnetic.

4. The parasol of claim 1 wherein the formed top of said handle portion comprises a generally circular member having a ramped portion formed on one portion of said top plate.

5. The parasol of claim 4 wherein said ramp portion has a plurality of steps and further wherein each of said plurality of steps has a section of hook and loop type fastener placed thereon.

* * * * *